US008242413B2

(12) United States Patent
Choi et al.

(10) Patent No.: US 8,242,413 B2
(45) Date of Patent: Aug. 14, 2012

(54) METHOD OF CONTROLLING OVEN

(75) Inventors: Moo Yeon Choi, Changwon (KR); Eui-Seog Jeong, Changwon (KR)

(73) Assignee: LG Electronics Inc., Seoul (KR)

( * ) Notice: Subject to any disclaimer, the term of this patent is extended or adjusted under 35 U.S.C. 154(b) by 92 days.

(21) Appl. No.: 12/514,841

(22) PCT Filed: Nov. 15, 2007

(86) PCT No.: PCT/KR2007/005744

§ 371 (c)(1),
(2), (4) Date: Apr. 12, 2010

(87) PCT Pub. No.: WO2008/066267

PCT Pub. Date: Jun. 5, 2008

(65) Prior Publication Data

US 2010/0198410 A1 Aug. 5, 2010

(30) Foreign Application Priority Data

Nov. 29, 2006 (KR) ..... 10-2006-0118686
Feb. 23, 2007 (KR) ..... 10-2007-0018251

(51) Int. Cl.
*A21B 1/00* (2006.01)
*F24C 15/32* (2006.01)

(52) U.S. Cl. ..... 219/391; 219/385; 219/386; 219/387; 219/412; 219/413; 219/414; 219/400; 126/335; 126/339; 126/332; 99/444; 99/445; 99/446; 99/450; 99/400

(58) Field of Classification Search ..... 219/391–2, 219/385–7, 394, 412–4, 400; 126/21 A, 126/335, 332, 339; 99/444–6, 450, 400
See application file for complete search history.

(56) References Cited

U.S. PATENT DOCUMENTS

| | | | | |
|---|---|---|---|---|
| 6,943,321 | B2 * | 9/2005 | Carbone et al. | 219/400 |
| 7,129,447 | B1 | 10/2006 | Kim et al. | |
| 7,442,901 | B2 * | 10/2008 | Kim et al. | 219/394 |

FOREIGN PATENT DOCUMENTS

| | | | |
|---|---|---|---|
| EP | 1 437 552 | A1 | 7/2004 |
| EP | 1 542 511 | A1 | 6/2005 |
| EP | 1 674 796 | A2 | 6/2006 |
| EP | 1 748 255 | A2 | 1/2007 |
| JP | 6-281148 | A | 10/1994 |
| JP | 9-126463 | A | 5/1997 |
| JP | 9-303791 | A | 11/1997 |
| JP | 11-325478 | A | 11/1999 |
| KR | 2000-0009940 | A | 2/2000 |
| KR | 2003-0088652 | A | 11/2003 |
| KR | 10-2005-0081371 | A | 8/2005 |
| KR | 10-2006-0056765 | A | 5/2006 |
| KR | 10-2006-0091857 | A | 8/2006 |
| WO | WO 2005/066549 | A1 | 7/2005 |

* cited by examiner

*Primary Examiner* — Shawntina Fuqua
(74) *Attorney, Agent, or Firm* — Birch, Stewart, Kolasch & Birch, LLP

(57) ABSTRACT

A method of controlling an oven is provided. The oven includes a first heater, a second heater having a lower output than the first heater, at least one third heater, and at least one fan blowing a heat of the third heater to a cavity. The first heater operates for cooking food and then the second heater operates after the first heater stops. Then, the third heater and the fan continuously operate while the first heater and second heater operate.

9 Claims, 7 Drawing Sheets

[Fig. 1]
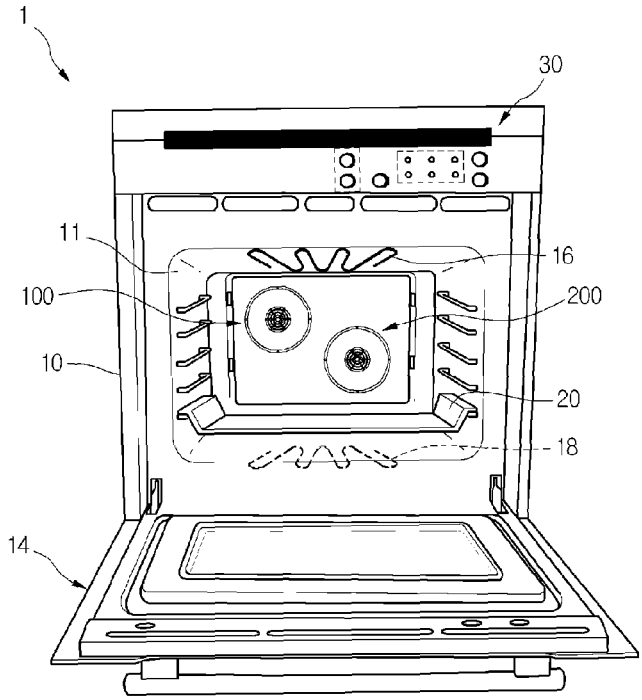
[Fig. 2]
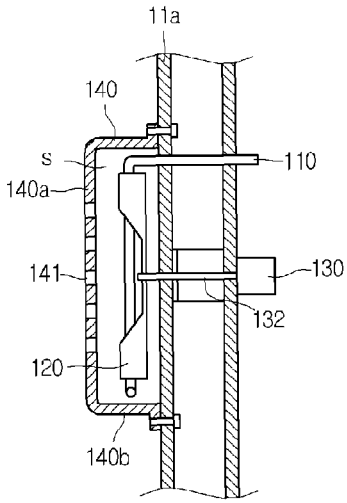
[Fig. 3]
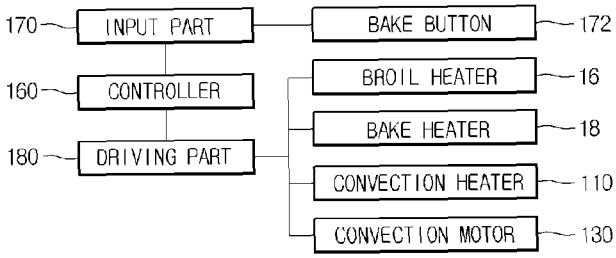

[Fig. 4]
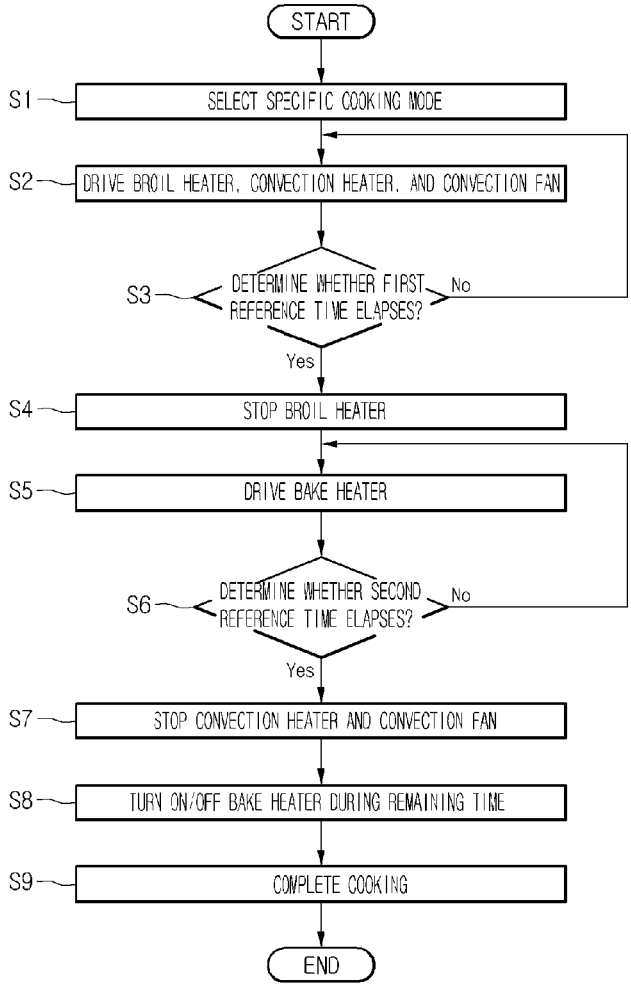
[Fig. 5]
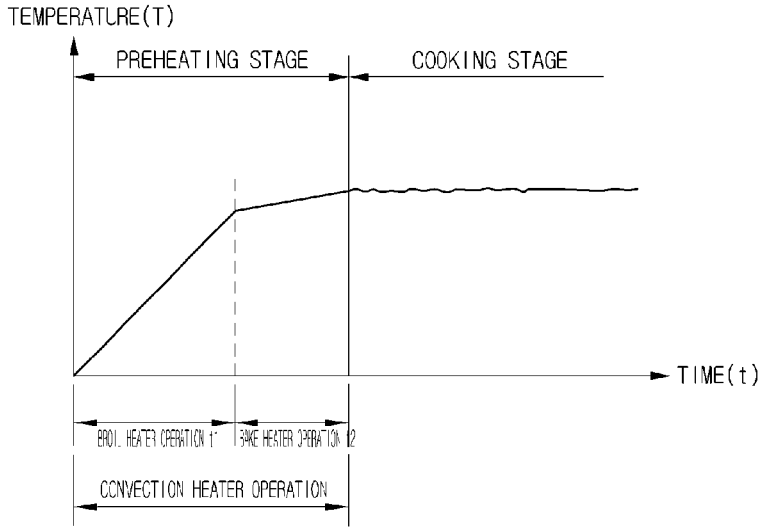

[Fig. 6]
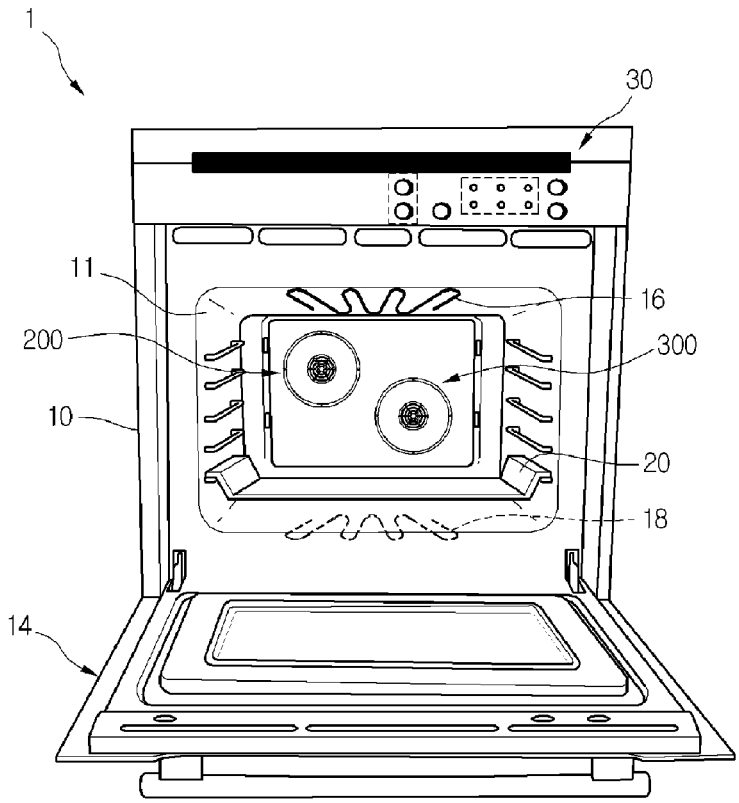
[Fig. 7]
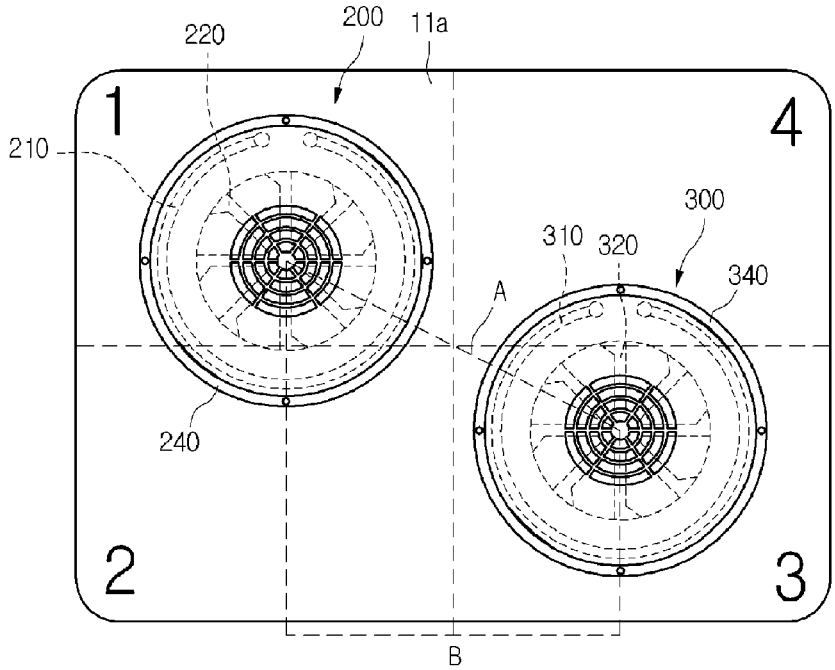

[Fig. 8]
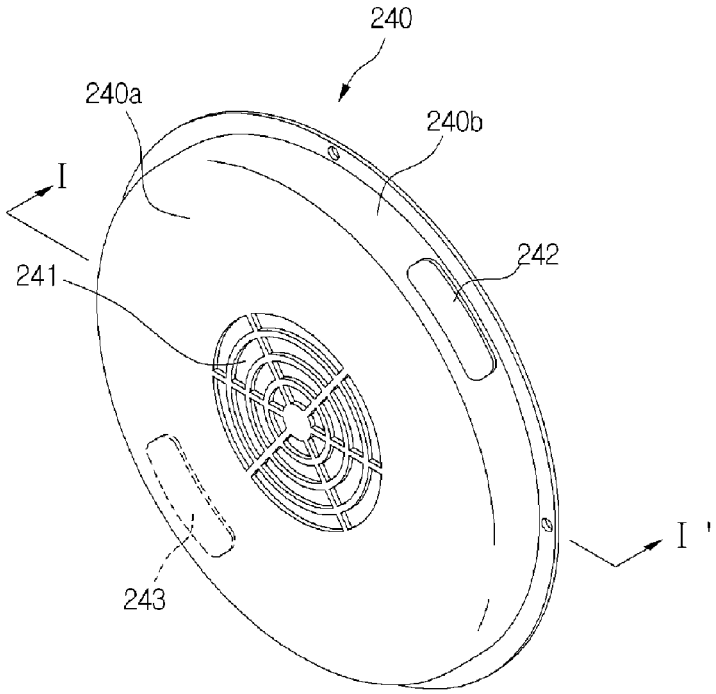
[Fig. 9]
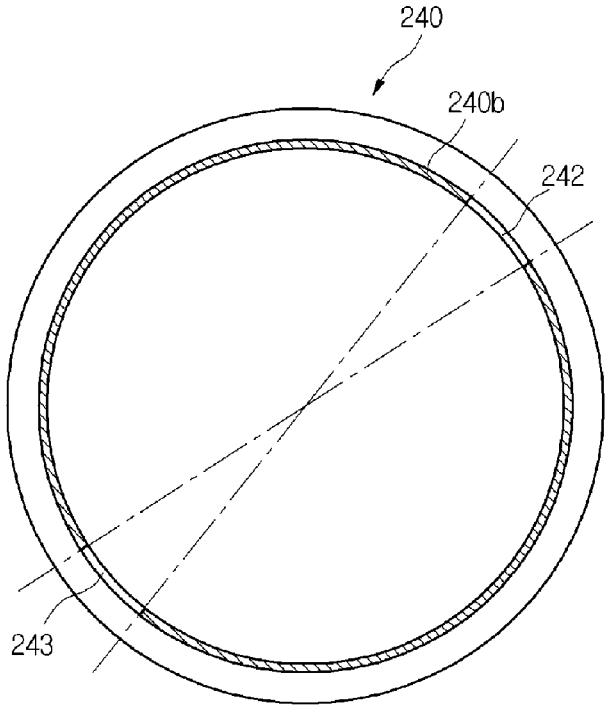

[Fig. 10]
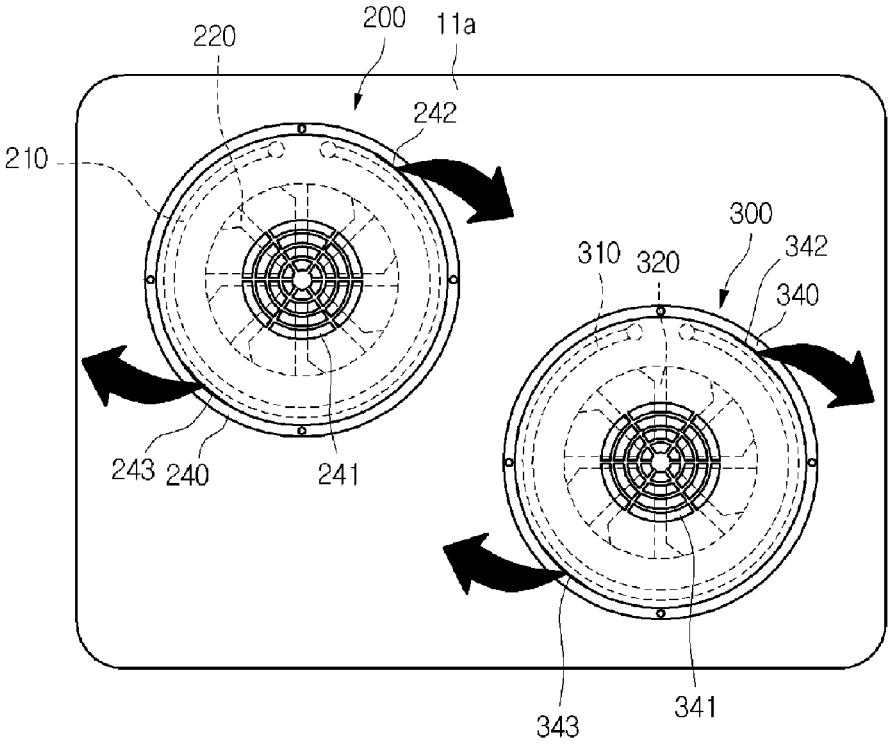
[Fig. 11]
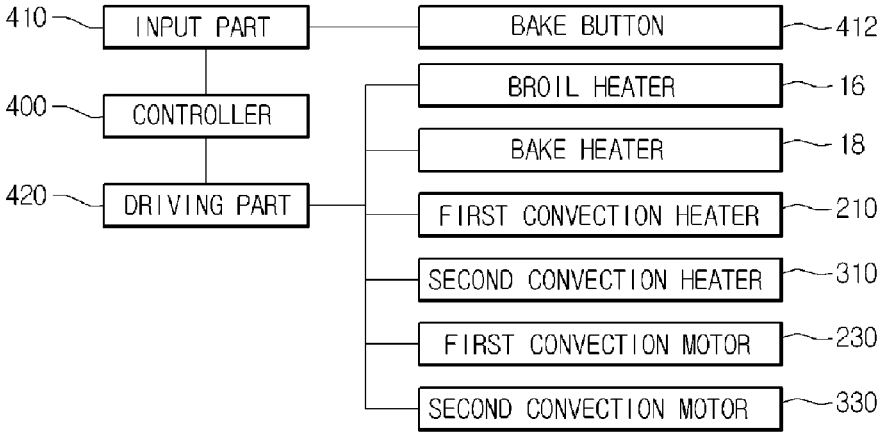

[Fig. 12]
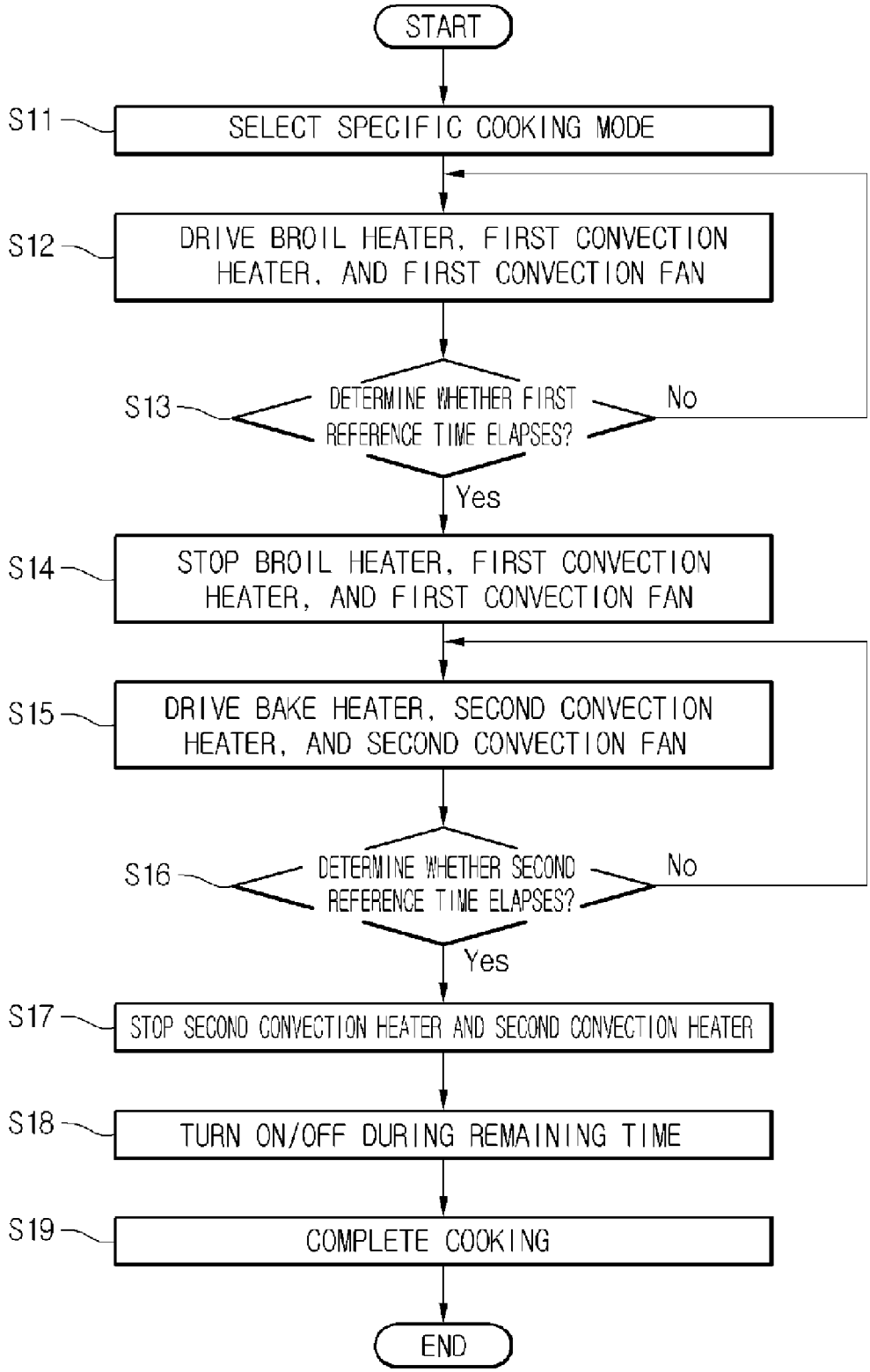

[Fig. 13]
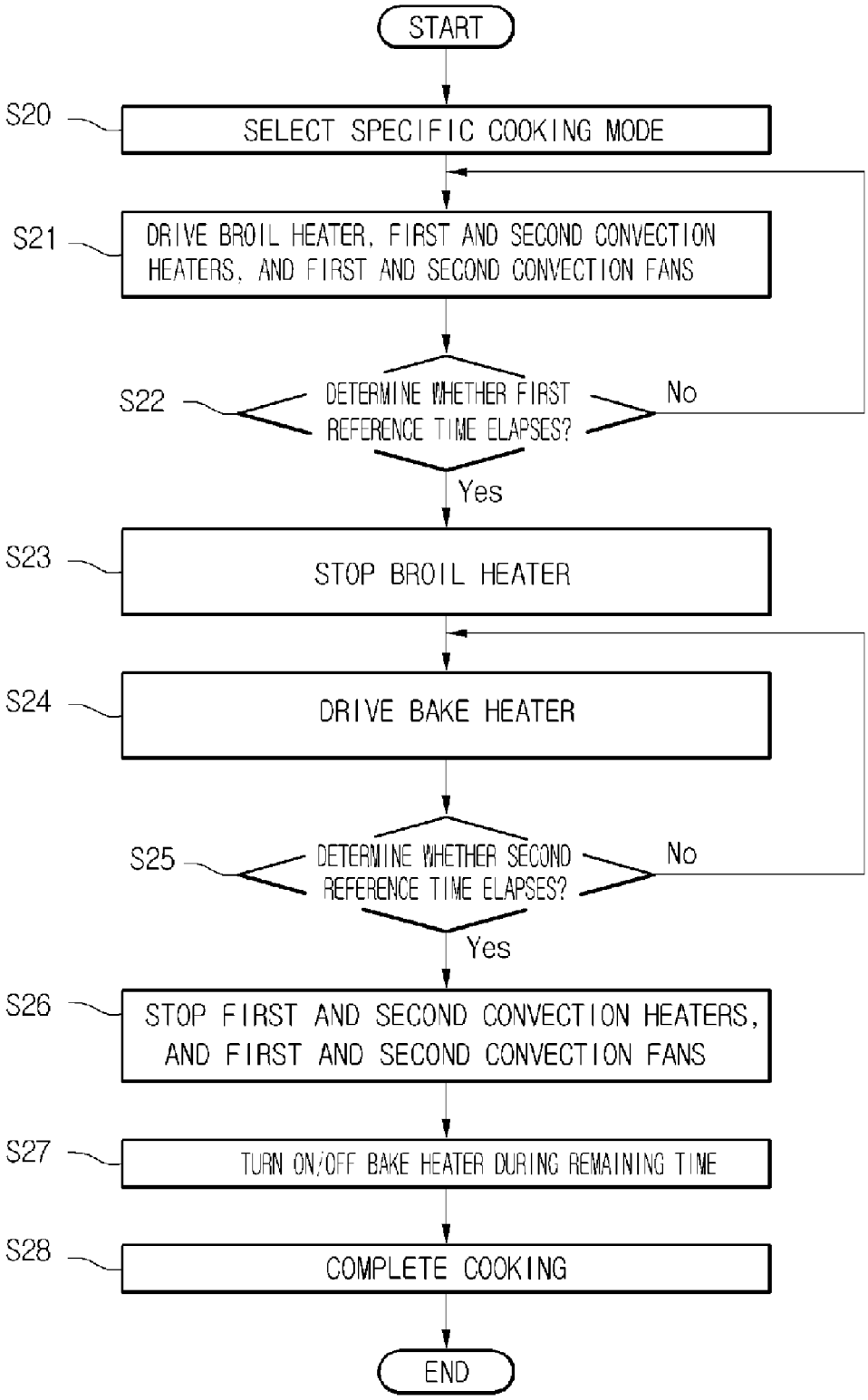

METHOD OF CONTROLLING OVEN

TECHNICAL FIELD

The present disclosure relates to a method of controlling an oven.

BACKGROUND ART

In general, an oven heats food to be cooked in a cooking compartment. A cooking method of this oven may be largely classified into a method using radiation of a heater for cooking, and a method circulating heat of a heater to use hot air for cooking.

The hot air circulation oven includes a cavity forming a cooking space, a blower fan, a motor driving the blower fan, and a convection heater surrounding the blower fan. The blower fan and the heater are covered by a casing combined in the cavity.

A suction port is formed at roughly the middle of the rear wall of the cavity, and a discharge port is formed around the suction port.

Accordingly, when the blower fan rotates, air in the cavity is suctioned into the casing through the suction port, and air heated by the convection heater in the casing is supplied into the cavity through the discharge port.

DISCLOSURE OF INVENTION

Technical Problem

*Embodiments provide a method of controlling an oven capable of reducing a preheating time in a cavity when the oven operates.

Embodiments also provide a method of controlling an oven capable of reducing a preheating time in a cavity, such that an overall cooking time is reduced.

Technical Solution

In one embodiment, a method of controlling an oven, the oven including a first heater, a second heater having a lower output than the first heater, at least one third heater, and at least one fan blowing a heat of the third heater to a cavity, the method including: operating the first heater for cooking food and then operating the second heater after the first heater stops; and continuously operating the third heater and the fan while the first heater and second heater operate.

In another embodiment, a method of controlling an oven, the oven including a broil heater heating food to be cooked in a cavity, a bake heater, a plurality of convection heaters, and a plurality of fans blowing heat of each of the convection heaters into the cavity, the method including: operating the broil heater, the first convection heater, and the first fan during a first reference time and then stopping them when the first reference time elapses; and operating the bake heater, the second convection heater, and the second fan during a second reference time.

In a further embodiment, a method of controlling an oven, the oven including a broil heater, a bake heater having a lower output than the broil heater, a plurality of convection heaters, and a plurality of fans blowing a heat of the convection heater into the cavity, the method including: performing a preheating mode to increase a cooking temperature; and performing a cooking mode to substantially sustain the cooking temperature. The broil heater operates during a first reference time in the preheating mode, and then the bake heater operates during a second reference time after the brail heater stops; at least the first convection heater and the first fan, adjacent to the broil heater, operate while the broil heater operates; and at least the second convection heater and the second fan, adjacent to the broil heater, operate while the bake heater operates.

ADVANTAGEOUS EFFECTS

According to the present disclosure, a preheating of an oven is performed first by a high output broil heater, and then is performed by a low output bake heater, such that a preheating time can be reduced, and also an overall cooking time can be reduced.

Additionally, since the inside of a cavity is heated up to a required temperature during a preheating mode through the high output broil heater, preheating can be promptly obtained, and also food can be prevented from being over-cooked or over-burned.

Additionally, during a preheating mode, when a broil heater operates, at least one convection heater adjacent to a broil heater operates, and also when the bake heater operates, at least a convection heater adjacent to the bake heater operates. Therefore, heat concentration can be more efficiently achieved.

BRIEF DESCRIPTION OF THE DRAWINGS

FIG. 1 is a perspective view of an oven according to a first embodiment.

FIG. 2 is a sectional view of a structure of a convection assembly according to a first embodiment.

FIG. 3 is a block diagram of a control structure of an oven according to a first embodiment.

FIG. 4 is a flowchart illustrating a method of controlling an oven according to a first embodiment.

FIG. 5 is a graph illustrating a temperature in a cavity according to an operating time of an oven.

FIG. 6 is a perspective view of an oven according to a second embodiment.

FIG. 7 is a view geometrically illustrating a relationship between convection assemblies according to a second embodiment.

FIG. 8 is a perspective view of a cover member according to a second embodiment.

FIG. 9 is a sectional view taken along line I-I' of FIG. 8.

FIG. 10 is a view illustrating air flow in a cavity when an oven operates according to a second embodiment.

FIG. 11 is a block diagram of a control structure of an oven according to a second embodiment.

FIG. 12 is a flowchart illustrating a method of controlling an oven according to a second embodiment.

FIG. 13 is a flowchart illustrating a method of controlling an oven according to a third embodiment.

BEST MODE FOR CARRYING OUT THE INVENTION

Hereinafter, preferred embodiments of the present disclosure will be described in detail with reference to accompanying drawings.

FIG. 1 is a perspective view of an oven according to a first embodiment. FIG. 2 is a sectional view of a structure of a convection assembly according to the first embodiment.

Referring to FIGS. 1 and 2, the oven 1 of the first embodiment includes an external case 10 forming an outer appearance, a cavity 11 disposed in the external case 10 and forming a cooking space, a door 14 selectively opening/closing the cavity 11, a food supporter 20 installed in the cavity 11 to place food to be cooked, a heat source heating the food on the food supporter 20, and a control panel 30 disposed on one side of the external case 10 for a user to manipulate.

More specifically, a broil heater 16 is provided on the top of the cavity 11, and a bake heater 18 having a lower output than the broil heater 16 is provided on the bottom of the cavity 11. A convection assembly 100 discharging a heated air into the cavity 11 is provided at the rear of the cavity 11.

The convection assembly 100 includes a convection fan 120 and a convection motor 130. The convection fan 120 supplies air heated by the convection heater 110 into the cavity 11. The convection motor 130 drives the convection fan 120.

Here, the broil heater 16 may be a first heater, the bake heater 18 may be a second heater, and the convection heater 110 may be a third heater.

Also, the convection heater 110 and the convection fan 120 are covered by a cover member 140. The cover member 140 is connected to the cavity rear wall 11*a* at the inside of the cavity 11. The convection heater 110 and the convection fan 120 are placed in a space s formed by the cover member 140 and the cavity rear wall 11*a*.

That is, the convection heater 110 and the convection fan 120 are provided in the cavity 11. The convection fan 120 is combined to an axis 132 of the motor 130 passing through the rear of the cavity 11.

Here, the cover member 140 surrounds the convection heater 110 and the convection fan 120 in the cavity 11 to prevent them from being exposed to the outside.

The cover member 140 is combined to the inside of the cavity 11 and protrudes from the cavity rear wall 11*a* to the front. Also, the cover member 140 has a cylindrical form.

Then, a suction hole 141 is formed in the front 140*a* of the cover member 140 to suction air in the cavity 11 into the space s formed by the cover member 140 and the cavity rear wall 11*a*. A plurality of discharge holes is formed in the circumferential surface 140*b* (or, the side surface) to discharge the air heated by the convection heater 110. Since the discharge holes are formed only on the circumferential 140*b* of the cavity 11, the air discharged through the discharge hole flows toward both sides of the cavity 11.

FIG. 3 is a block diagram of a control structure of an oven according to a first embodiment.

Referring to FIG. 3, the oven of the first embodiment includes an input part 170 inputting operating conditions of the oven through a user, a driving part 180 driving the oven in response to a signal inputted through the input part 170, and a controller 160 controlling the driving part 180.

More specifically, the input part 170 inputs various cooking conditions according to kinds of foods through a user, and includes a plurality of buttons selecting the cooking conditions according to kinds of foods. For example, the input part 170 includes a bake button 172, which may be selected for cooking different kinds of breads.

The driving part 180 drives the oven according to the cooking conditions inputted through the input part 170, and selectively drives the broil heater 16, the bake heater 18, the convection heater 110, and the convection motor 130 according to the inputted cooking conditions.

On the other hand, the controller 160 controls the driving part 180 to satisfy the cooking conditions inputted through the input part 170.

Hereinafter, a method of controlling the above oven will be described below.

FIG. 4 is a flowchart illustrating a method of controlling the oven according to the first embodiment. FIG. 5 is a graph illustrating a temperature in the cavity according to an operating time of the oven.

Referring to FIGS. 4 and 5, a specific mode is selected by a user in operation S1. The specific mode may be a bake mode selected by pressing a bake button 172. Then, the oven operates in a preheating mode, and then operates in a cooking mode.

First, the preheating mode is described. Once the bake mode selected, the broil heater 16, the convection heater 110, and the convection fan 120 are driven to heat the inside of the cavity 11 in operation S2.

That is, the inside of the cavity 11 is heated first by the broil heater 16 having a high output power during a bake mode. In this case, a temperature at the inside of the cavity 11 rapidly increases.

Then, it is determined whether an operating time of each of heaters 16 and 110 elapses a first reference time or not while the broil heater 16 and the convection heater 110 operate in operation S3.

If the operating time elapses the first reference time, the broil heater 16 stops in operation S4.

Then, the bake heater 18 operates in correspondence to the stop of the broil heater 16 in operation S5. At this point, the convection heater 110 and the convection fan 120 continuously operate without stopping.

Here, the reason that the broil heater 16 operates only during the first reference time is to prevent food to be cooked from being over-cooked or over-burned, which may be caused by the high output broil heater 16.

Also, the first reference time is a duration until a temperature in the cavity 11 reaches from between approximately 85% and approximately 90% of a required internal temperature at the cavity 11 during the preheating mode.

Here, it is apparent that the cavity 11 includes a temperature sensor therein to detect a temperature in the cavity 11.

In operation S6, it is determined whether an operating time of each of heaters 18 and 110 elapses a second reference time while the bake heater 18 and the convection heater 110 operate.

In operation S7, if the operating time of each of the heaters 18 and 110 elapses the second reference time, the broil heater 16 and the bake heater 18 stop, and the preheating mode is completed.

After the preheating mode is completed, the oven operates in a cooking mode. The bake heater 18 is turned off/on during a remaining time until cooking completion in operation S8.

After the remaining time elapses, the cooking mode is completed, and thus the food is completely cooked in operation S9.

The high output broil heater 16 operates first, and then the low output bake heater 18 operates according to control of the above embodiment.

As illustrated in FIG. 5, since the inside of the cavity 11 is heated to a temperature required in the preheating mode through the high output broil heater 16, the food to be cooked is not over-burned and a prompt preheating is possible.

FIG. 6 is a perspective view of an oven according to a second embodiment.

Referring to FIG. 6, the oven of the second embodiment includes a plurality of convection assemblies 200 and 300.

In detail, each of the convection assemblies 200 and 300 includes a heater, a convection fan, and a motor. Each of the convection heater and the convection fan is covered by each cover member.

That is, the cover member serves as a partition that spatially separates the convection heater and the convection fan in the cavity 11.

Since each convection heater and each convection fan are spatially separated by the cover member, each of convection assemblies 200 and 300 operates independently.

That is, one convection assembly is unaffected by the other when the convection fan and the convection heater operate in the one convection assembly.

Here, although the convection assemblies 200 and 300 have the same structure, the installation position of each of the convection assemblies varies and thus their air flows are different from each other.

Hereinafter, the relationship between the convection assemblies 200 and 300 will be described before mentioning a method of controlling the oven of the above structure.

FIG. 7 is a view geometrically illustrating a relationship between convection assemblies according to the second embodiment.

Referring to FIG. 7, a plurality of convection fans (or, convection assemblies) is provided on the cavity rear wall 11*a*. In this embodiment, a pair of convection fans is provided as one example.

The pair of convection fans 220 and 320 determines its position to uniformly circulate heated air in the cavity 11 according to two geometric aspects.

More specifically, the pair of convection fans 220 and 320 includes a left convection fan 220 and a right convection fan 320.

The each of the pair of convection fans 220 and 320 has respectively different heights. That is, the axis of the left convection fan 220 is placed higher than the axis of the right convection fan 320, using the bottom of the cavity 11 as a base level. In this embodiment, the axis of the left convection fan 220 is placed higher than the axis of the right convection fan 320, but this can be reversed.

According to this embodiment, a distance of an imaginary first line A between the axes of the convection fans 220 and 230 is greater than a horizontal projection of the first line A, or, a distance of a second line B connecting the shafts (when viewed downward from above.)

In the case where the axes of the convection fans 220 and 320 are placed in respectively different positions, the air discharged by the convection fans 220 and 320 is entirely spread in the cavity 11.

On the other hand, the pair of convection fans 220 and 320 may be approximately point symmetric in order to uniformly spread the heated air into the cavity 111 through the pair of convection fans 220 and 320.

That is, this prevents the heated air from being concentrated on one side, which occurs when the left convection fan 220 and the right convection fan 320 are placed on one side.

More specifically, the cavity rear wall 11*a* is divided into four quadrants with the same central angle. Then, the axis of the left convection fan 220 is placed on one of the four quadrants. Here, a quadrant where the axis of the left convection fan 220 is placed may be called a first quadrant, and the quadrants progressing counterclockwise from the first quadrant may respectively be a second quadrant, a third quadrant, and a fourth quadrant.

The axis of the right convection fan 320 is placed on the third quadrant that is diagonally placed from the first quadrant. That is, the axis of one convection fan is the left, and the axis of the other convection fan is the right with respect to a line bisecting the cavity rear wall 11*a*.

Here, the axis of the left convection fan 220 is placed on the first quadrant and the axis of the right convection fan 320 is placed on the second quadrant, heated air is concentrated on the axis of the left portion in the cavity 11. When the axis of the right convection fan 320 is placed on the fourth quadrant, heated air is concentrated on the top in the cavity 11.

Accordingly, to uniformly distribute the heated air in the cavity 11, the axis of the right convection fan 320 is placed on a quadrant that is diagonally placed from the axis of the right convection fan 220.

When the pair of convection fans 220 and 320 is placed in according to the two geometric aspects, the air heated by each of the convection heaters 210 and 310 is uniformly distributed in the cavity 11. Accordingly, the food to be cooked is uniformly heated.

FIG. 8 is a perspective view of a cover member according to a second embodiment. FIG. 9 is a sectional view taken along line I-I' of FIG. 8.

Referring to FIGS. 8 and 9, the cover member 240 includes a front 240*a* and a circumference part 240*b* that vertically extends from the front 240*a*. The cover member 240 has a cylindrical form.

A suction port 241 is formed at the middle of the front 240*a* to suction air in the cavity 11 into the space. A plurality of discharge holes is formed at the circumference part 240*b* to discharge air heated by the convection heater 210 into the cavity.

In more detail, the discharge hole includes a first discharge hole 242 at the right top of the cover member 240 and a second discharge hole 243 at the left bottom of the cover member 240. Accordingly, when the convection fan 220 rotates, air heated by the convection heater 210 flows into the cavity 11 through the right top and the left bottom of the cover member 240.

FIG. 10 is a view illustrating air flow in a cavity when an oven operates according to a second embodiment.

Referring to FIG. 10, when a user puts food to be cooked in the cavity 11, and presses a start button, each of the convection heaters 210 and 310 generates heat and each of convection fans 220 and 320 rotates.

Air in the cavity 11 is suctioned into each space s through each of suction ports 241 and 341. Then, the air is heated by each of the convection heaters 210 and 310 and then is discharged into the cavity 11 through each of discharge holes.

In more detail, the air, which is discharged through the second discharge hole 243 of the left cover member 240, flows toward the left wall of the cavity 11 because the second discharge hole 243 is close to the left wall of the cavity 11. Then, when the air contacts the left wall of the cavity 11, most of the air flows toward the left top along the left wall.

The air discharged through the first discharge hole 242 of the left cover member 240 flows toward the right top of the cavity 11.

The air, which is discharged through the first discharge hole 342 of the left cover member 340, flows toward the right wall of the cavity 11 because the first discharge hole 342 is close to the right wall of the cavity 11. Then, when the air contacts the right wall of the cavity 11, most of the air flows toward the right bottom along the right wall.

The air discharged through the second discharge hole 343 of the right cover member 340 flows toward the left bottom of the cavity 11.

According to this embodiment, the air heated by each of the convection heaters 210 and 310 is equally discharged in the cavity.

According to this embodiment, once cooking begins, each of the convection heaters 210 and 310 and each of the convection fans 220 and 320 operates. According to the food to be cooked, each of the convection heaters 210 and 310 and each of the convection fans 220 and 320 may operate alternately.

That is, discharging the air heated by the left convection assembly 200 into the cavity 11 and then discharging the air heated by the right convection assembly 300 into the cavity 11 may be alternately performed.

In this case, since the heated air may be alternately concentrated on the top and bottom of the cavity 11, the food to be cooked can be uniformly heated during a whole cooking process.

Additionally, although the convection fans 220 and 320 rotate in the same direction (e.g., a clockwise direction) in FIG. 10, they may rotate in respectively different directions. That is, one convection fan rotates in a clockwise direction and the other rotates in a counterclockwise direction.

FIG. 11 is a block diagram of a control structure of an oven according to a second embodiment. FIG. 12 is a flowchart illustrating a method of controlling an oven according to a second embodiment.

Referring to FIG. 11, the oven of this embodiment includes an input part 410 controlling an operation status of the oven through a user, a driving part 420 driving the oven in response to a signal inputted through the input part 410, and a controller 400 controlling the driving part 420.

In more detail, the driving part 420 selectively drives the broil heater 16, the bake heater 18, the first convection heater 210, the first convection motor 230, the second convection heater 310, and the second convection motor 330.

Hereinafter, a method of controlling the oven with the above structure will be described in more detail.

Referring to FIG. 12, a specific mode is selected by a user in operation S11. The specific mode may be a bake mode that is selected by the bake button 412. Then, the oven operates in a preheating mode, and thereafter operates in a cooking mode.

First, when the preheating mode is described, the broil heater 16, the first convection heater 210, and the first convection fan 220 are driven to heat the inside of the cavity 11 in operation S12.

That is, according to this embodiment, the inside of the cavity 11 is heated first by the high output broil heater 16 and the first convection heater 210 that is relatively close to the broil heater 16.

Then, while the broil heater 16 and the first convection heater 210 operate, it is determined whether an operating time of each of the heaters 16 and 210 elapses a first reference time or not in operation S13.

If the operating time of each of the heaters 16 and 210 elapses the first reference time, the broil heater 16, the first convection heater 210, and the first convection fan 220 stop in operation S14.

Then, the bake heater 18 operates in correspondence to the stop of the broil heater 16, and then the first convection heater 310 and the second convection fan 320 operate in operation S15.

That is, each of the convection heaters 210 and 310 alternately operates, but the convection heater 210 and 310 continuously operate during the preheating mode of the oven in a driving aspect of the convection heaters 210 and 310.

Then, while the bake heater 18 and the second convection heater 310 operate, it is determined whether an operating time of each of the heaters 18 and 310 elapses a second reference time or not in operation S16.

If the operating time of each of the heaters 18 and 310 elapses the second reference time, the bake heater 18, the second convection heater 310, and the second convection fan 320 stop, and according to that, the preheating mode is completed in operation S17.

Then, after the preheating mode is completed, the oven operates in a cooking mode. The bake heater 18 is turned on/off during a remaining time until cooking completion in operation S18. Then, after the remaining time is elapsed, the cooking mode is completed, and cooking of the food is completed in operation S19.

FIG. 13 is a flowchart illustrating a method of controlling an oven according to a third embodiment.

Referring to FIG. 13, a specific mode is selected by a user in operation S20. The specific mode may be a bake mode that is selected by the bake button 412. Then, the oven operates in a preheating mode, and thereafter operates in a cooking mode.

First, when the preheating mode is described, the broil heater 16, the first and second convection heaters 210 and 310, and the first and second convection fans 220 and 320 are driven to heat the inside of the cavity 11 in operation S21.

That is, according to this embodiment, the inside of the cavity 11 is heated first by the high output broil heater 16 and the first and second convection heater 210 and 320.

Then, while the broil heater 16 and the first and second convection heaters 210 and 310 operate, it is determined whether an operating time of each of the heaters 16, 210, and 310 elapses a first reference time or not in operation S22.

If the operating time of each of the heaters 16, 210, and 310 elapses the first reference time, the broil heater 16 stops in operation S23.

Then, the bake heater 18 operates in correspondence to the stop of the broil heater 16 in operation S24. When the broil heater 16 stops, each of the convection heater 210 and 310 and the motors 230 and 330 continuously operates while the bake heater 18 operates.

*That is, during the preheating mode of the oven in this embodiment, each of the convection heaters 210 and 310 continuously operates.

While the bake heater 18 and the first and second convection heaters 210 and 310 operate, it is determined whether an operating time of each of heaters 18, 210, and 310 elapses a second reference time or not in operation S25.

If the operating time of each of heaters 18, 210, and 310 elapses the second reference time, the first and second convection heater 210 and 310 and the first and second convection fans 220 and 320 stop, and according to that, the preheating mode is completed in operation S26.

Then, after the preheating mode is completed, the oven operates in the cooking mode. The bake heater 18 is turned on/off during a remaining time until the cooking completion in operation S27. When the remaining time is elapsed, the cooking mode is completed, and also cooking of the food is completed in operation S28.

The invention claimed is:

1. A method for controlling preheating of an oven, the oven including a broil heater heating food to be cooked in a cavity, a bake heater, a plurality of convection heaters, and a plurality of fans blowing heat of each of the convection heaters into the cavity, the method comprising:

operating the broil heater, a first convection heater, and a first fan during a first reference time and then stopping them when the first reference time elapses; and operating the bake heater, a second convection heater, and a second fan during a second reference time, wherein operating and stopping of the broil heater is dependent on operating and stopping of the first convection heater and the first fan, wherein operating of the bake heater is dependent on operating of the second convection heater and the second fan, and wherein stopping of the bake heater is not dependent on stopping the second convection heater and the second fan.

2. The method for controlling preheating of the oven according to claim 1, wherein the broil heater is disposed on a top of the cavity; and the bake heater is disposed on a bottom of the cavity.

3. The method for controlling preheating of the oven according to claim 2, wherein the first fan is closer to the broil heater than the second fan, and the second fan is closer to the bake heater than the first fan.

4. A method of controlling an oven, the oven including a broil heater, a bake heater having a lower output than the broil heater, a plurality of convection heaters, and a plurality of fans blowing heat of each of the convection heaters into a cavity of the oven, the method comprising:

performing a preheating mode to increase a cooking temperature; and performing a cooking mode to substantially sustain the cooking temperature, wherein the broil heater operates during a first reference time in the preheating mode, and then the bake heater operates during a second reference time after the broil heater stops, wherein operating and stopping of the broil heater is dependent on operating and stopping of a first convection heater and a first fan, wherein operating of the bake heater is dependent on operating of a second convection heater and a second fan, and wherein stopping of the bake heater is not dependent on stopping of the second convection heater and the second fan.

5. The method according to claim 4, wherein the bake heater is continuously turned on/off during the cooking mode.

6. The method according to claim 4, wherein the broil heater is disposed on the top of the cavity, and the bake heater is disposed on the bottom of the cavity.

7. The method according to claim 4, wherein the plurality of convection heaters and fans continuously operate during the preheating mode.

8. The method for controlling preheating of an oven according to claim 1, further comprising stopping the second convection heater and the second fan when the second reference time elapses.

9. The method for controlling preheating of an oven according to claim 8, further comprising turning off/on the bake heater after the second reference time elapses.

* * * * *